US007527475B1

(12) United States Patent
Liang

(10) Patent No.: US 7,527,475 B1
(45) Date of Patent: May 5, 2009

(54) TURBINE BLADE WITH A NEAR-WALL COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 398 days.

(21) Appl. No.: 11/503,546

(22) Filed: Aug. 11, 2006

(51) Int. Cl.
*F01D 5/18* (2006.01)

(52) U.S. Cl. ..... 416/97 R

(58) Field of Classification Search ..... 415/115; 416/96 R, 97 R

See application file for complete search history.

(56) References Cited

U.S. PATENT DOCUMENTS

| | | | | |
|---|---|---|---|---|
| 3,533,711 | A | 10/1970 | Kercher | |
| 3,533,712 | A | 10/1970 | Kercher | |
| 4,529,357 | A | 7/1985 | Holland | |
| 4,574,451 | A | 3/1986 | Smashey et al. | |
| 5,165,852 | A * | 11/1992 | Lee et al. | 416/97 R |
| 5,215,431 | A | 6/1993 | Derrien | |
| 5,326,224 | A | 7/1994 | Lee et al. | |
| 5,350,277 | A | 9/1994 | Jacala et al. | |
| 5,690,472 | A | 11/1997 | Lee | |
| 5,702,232 | A | 12/1997 | Mooe | |
| 5,941,687 | A | 8/1999 | Tubbs | |
| 6,264,428 | B1 * | 7/2001 | Dailey et al. | 416/97 R |
| 6,514,037 | B1 * | 2/2003 | Danowski et al. | 415/115 |
| 6,565,312 | B1 | 5/2003 | Horn et al. | |
| 6,808,367 | B1 | 10/2004 | Liang | |
| 6,910,864 | B2 | 6/2005 | Tomberg | |
| 6,984,102 | B2 | 1/2006 | Bunker et al. | |
| 6,997,679 | B2 | 2/2006 | Beddard et al. | |
| 7,033,136 | B2 | 4/2006 | Botrel et al. | |

* cited by examiner

*Primary Examiner*—Ninh H Nguyen
(74) *Attorney, Agent, or Firm*—John Ryznic

(57) ABSTRACT

An airfoil for a gas turbine engine, the airfoil including a cooling air passage to provide internal cooling for the airfoil. A supply passage is formed in the root of the airfoil to deliver cooling air to the airfoil. A series of near-wall cooling passages extend along the wall of the airfoil in a radial direction and provide near-wall cooling for the airfoil. Within the airfoil wall is a plurality of collector cavities separated by a rib. A first near-wall cooling passage carries cooling air from the supply passage, around the airfoil from pressure side to suction side, and then discharges the cooling air into a collector cavity. Adjacent near-wall cooling passages carry cooling air from the supply passage to the collector cavity in an opposite direction from the first near-wall cooling passage, from the suction side to the pressure side of the airfoil. Film cooling holes extend from the collector cavity to the external surface of the airfoil. A shower head cooling arrangement is supplies by the forward cavity while a trailing edge cooling holes are supplied by cooing air from an aft collector cavity. A tip region cooling channel connects the pressure side channel with the suction side channel, and provides near-wall cooling for the tip region.

22 Claims, 3 Drawing Sheets

TURBINE BLADE WITH A NEAR-WALL COOLING CIRCUIT

BACKGROUND OF THE INVENTION

1. Field of the Invention

The present invention relates generally to fluid reaction surfaces, and more specifically to turbine airfoils with a cooling circuit.

2. Description of the Related Art Including Information Disclosed under 37 CFR 1.97 and 1.98

Gas turbine engines, especially of the axial flow type, include turbines to convert a hot gas stream from the combustor into mechanical energy. The turbine is formed of an alternating series of stationary vanes or nozzles followed by a stage or rotating blades or buckets. The first stage vane and blade arrangement is exposed to the highest gas stream temperature. The higher the temperature into the turbine, the higher the efficiency of the gas turbine engine. As the hot gas flow passes through the turbine, the gas flow temperature progressively decreases as the turbine converts the high temperature gas into mechanical energy. In order to allow for high gas flow temperature into the turbine, internal air cooling of the vanes and blades, especially in the first and second stages of the turbine, is required.

In the Prior Art, both blades and vanes are cooled internally with cooling air that has been bled off from the compressor of the gas turbine engine. Since the turbine drives the compressor, air that is bled off from the compressor and not burned with a fuel in the combustor lowers the overall efficiency of the engine. Thus, the larger the amount of air bled off from the compressor the lower the engine overall efficiency. Another design problem with internal cooled turbine airfoils, especially for the blades, is the effect of stress when combined with high temperature loads on the blades. The blades rotate at high speeds and therefore induce high centrifugal force that produces high stress levels especially at the root of the blade. The stress levels on the blade are lower near the tip region. For this reason, blades are design to have lower operating temperatures near the root that at the tip. Thus, more cooling is required near the root of the blade than near the tip on the airfoil surface.

The prior art is filled with various inventions for providing internal cooling air passages within airfoils used in the gas turbine engine. Serpentine cooling passages are an effective arrangement for providing cooling to the blade as well as limiting the amount of cooling air bled off from the compressor. U.S. Pat. No. 6,264,428 B1 issued to Dailey et al on Jul. 24, 2001 entitled COOLED AEROFOIL FOR A GAS TURBINE ENGINE discloses a hollow cooled turbine blade with internal cooling passages. The blade root includes a cooling air inlet passage (22 in this patent) leading into a plurality of suction side radial cooling air passages (21 in this patent), reverses flow into a central plenum (16 in this patent), and then passes through a plurality of apertures (27 in this patent) into a plurality of radial cooling air passages (28 in this patent) on the pressure side of the airfoil. The Dailey et al patent passes the cooling air into the radial channel on the suction side, which is exposed to a lower gas flow temperature than is the pressure side. Also, use of the turbulators in the channels increases the pressure loss as the cooling air passes through, requiring a higher pressure head on the cooling air flow through the airfoil.

Another prior art patent, U.S. Pat. No. 5,702,232 issued to Moore on Dec. 30, 1997 entitled COOLED AIRFOILS FOR A GAS TURBINE ENGINE discloses a turbine blade with a feed chamber (58 in this patent) connected to re-supply holes (59 in this patent) that lead into feed passages (57 and 56 in this patent), which lead into film holes (65 in this patent) that discharge cooling air onto the airfoil surface. Because the film cooling holes (65 in this patent) lead from the radial channels (56 and 57 of this patent), the openings of the film cooling holes are without diffusers, or the wall thickness must be increased to allow for the use of diffusers on the hole openings.

In order to improve on the efficiency of a gas turbine engine, the operating temperature can be increased which requires improved cooling of the airfoil. Also, the efficiency of the engine can be improved by using less bleed air from the compressor. It is therefore an object of the present invention to provide improved cooling for an airfoil of a gas turbine engine that uses internal cooling passages supplies by a flow of cooling air. It is another object of the present invention to provide for a cooling circuit that also requires less cooling flow to provide cooling for the airfoil. Another object of the present invention is to provide for a turbine blade with more cooling at the root of the blade than at the tip of the blade without increasing the amount of cooling air needed to cool the blade.

BRIEF SUMMARY OF THE INVENTION

The present invention is a turbine blade with internal cooling passages that make use of a minimum amount of cooling air to perform a maximum amount of cooling for critical parts of the blade. The blade includes at least two mid-chord collector cavities separated by at least one rib extending from a pressure side to a suction side of the blade. Along the walls of the airfoil are a series of radial extending near wall cooling channels to provide near wall cooling for the pressure and suction sides. Film cooling holes extend from the collector cavities without making fluid contact with the radial extending channels. Cooling air supplied through the blade root flows up and into the pressure side radial extending channels to cool the pressure side, then into the tip region, and then down the suction side radial extending channels to cool the suction side before being discharged into the respective collector cavity. The adjacent radial channels have a cooling air flow in the opposite orientation to that above, in which the cooling air from the root supply passage flows into the suction side radial extending channel, around the tip region, and then down the pressure side radial extending channels, again discharging into the respective collection cavity. The series of channels alternate between pressure side to suction side flow direction and suction side to pressure side flow direction. Cooling air discharged into the collector cavities flows into the various film cooling holes to cool the leading edge, the trailing edge, and the pressure and suction side walls of the blade.

The present invention provides a number of benefits over the cited prior art references. The present invention blade cooling design utilizes a series of near wall cooling channels in the blade pressure and suction sides as well as the squealer tip provide convective cooling for the airfoil first, and then discharges the cooling air as film cooling for the airfoil. This counter flow and double use of cooling air will increase the overall blade cooling effectiveness. The blade tip rail impingement and elbow turning cooling corresponding to the entrance and exit locations of the tip section convection cooling flow channels arrangement enhances the blade squealer tip rail cooling. The near wall cooling utilized for the airfoil main body reduces conduction thickness and increases airfoil overall heat transfer convection capability, and therefore reduces the airfoil mass average metal temperature. The present invention cooling design increases the design flexibility to redistribute cooling flow and/or add cooling flow for each flow channel, and therefore increases the growth potential for the cooling design. Each individual cooling channel can be independently designed based on the local heat load and aerodynamic pressure loading conditions. Also, the through wall film cooling holes used in the cooling design of the present invention retain the length-to-diameter ratio and film hole length for diffusion, and therefore maintain a good film cooling effectiveness level that would not be found in an arrangement like that disclosed in the Moore U.S. Pat. No. 5,702,232 without having to provide for a thicker wall.

DETAILED DESCRIPTION OF THE INVENTION

Figure 1:
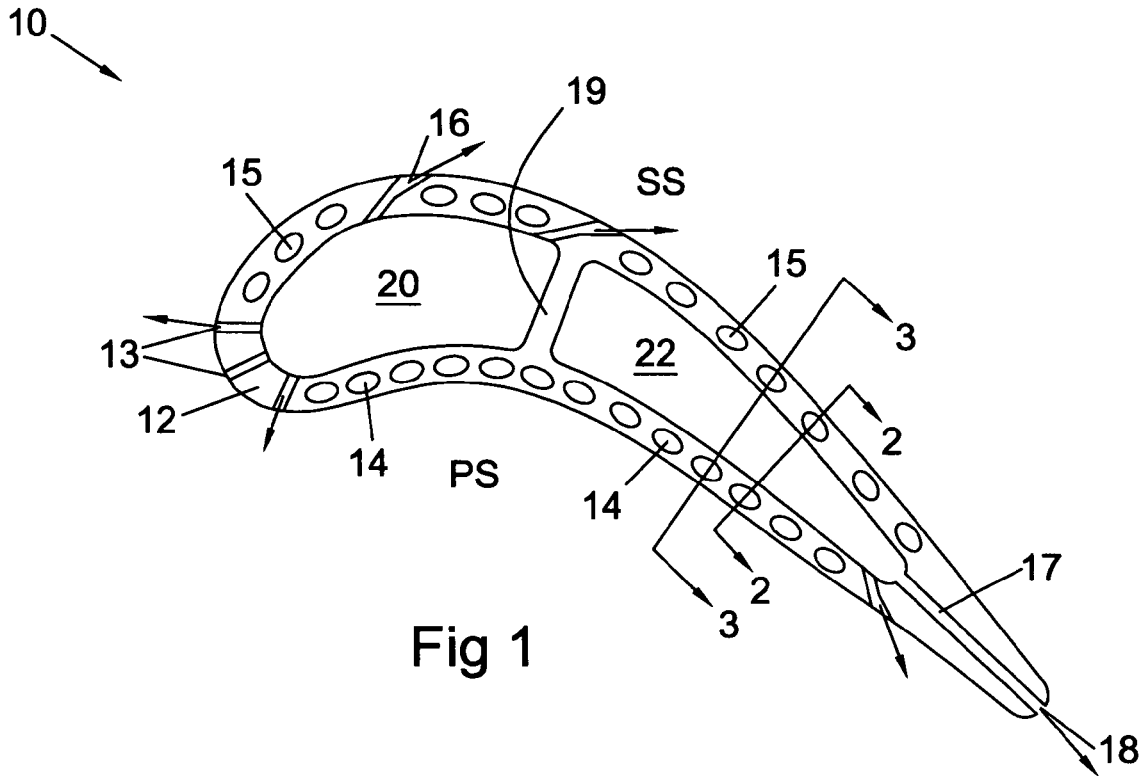
FIG. 1 shows a cut-away view of the airfoil of the present invention.

The present invention is an airfoil used in a turbine section of a gas turbine engine. The airfoil can be a blade or a vane, and is used in the forward section of the turbine where the higher temperatures require internal cooling of the airfoil. FIG. 1 shows a cut-away view of the turbine blade 10 of the present invention. The blade 10 includes a wall 12 that defines the pressure side (PS) and the suction side (SS) of the blade. The wall 12 also defines two or more mid-chord collector cavities 20 and 22 separated by a rib 19. FIG. 1 embodiment shows one rib 19 with two collector cavities. However, three or more collector cavities can be used depending upon the design requirements for the blade. A normal number of film cooling holes 13 and 16 extend from the collector cavities 20 and 22 and open onto the blade wall surface to provide film cooling. Shower head cooling holes 13 are supplied from the forward collector channel 20, while trailing edge cooling holes 18 are supplied by the aft collector channel 22 through trailing edge slots 17. The film cooling holes 16 spaced around the pressure and suction sides include diffusers to improve the film cooling effect. Spaced within the wall 12 is a plurality of radial extending cooling channels 14 and 15, with channels 14 being on the pressure side and channels 15 being on the suction side of the blade. The number of pressure side channels 14 can be equal to the number of suction side channels 15 which will be explained below. Or, a single pressure side channel can feed two or more suction side channels depending upon the design requirements. Not shown in the Figures is the squealer tip cooling holes to provide cooling air to the tip region 27. These cooling holes extend from the cavities 20 and 22 and open at the tip region 27. The tip region cooling holes also bypass the cooling channels passing along the tip region from the radial channels 14 or 15.

The pressure side channels 14 can be of a different diameter or cross sectional area than the suction side channels 15. Also, the pressure side channels can vary in cross sectional area size depending upon the cooling requirements for the section of the blade near the particular channel. The same for the suction side channels: they can have the same or different cross sectional areas to control the heat transfer rate from the blade to the cooling air flowing through the channels.

Figure 2:
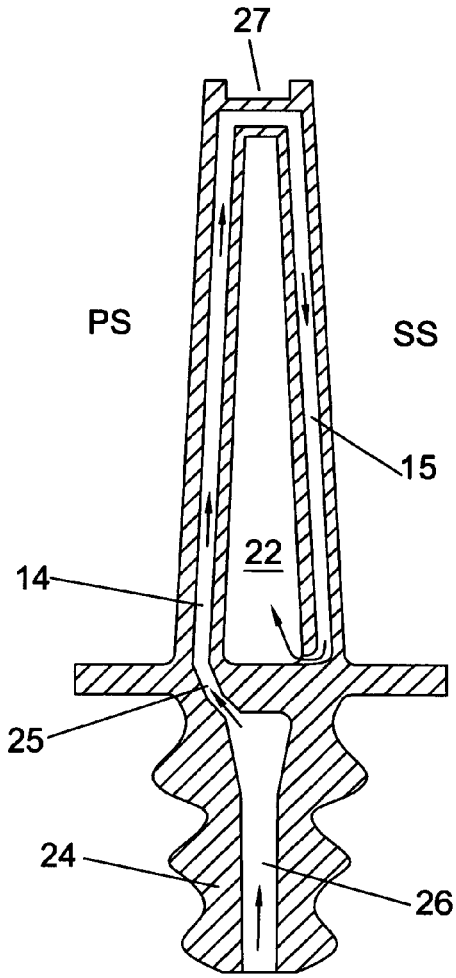
FIG. 2 shows a cross section view of a section of the FIG. 1 airfoil.
Figure 3:
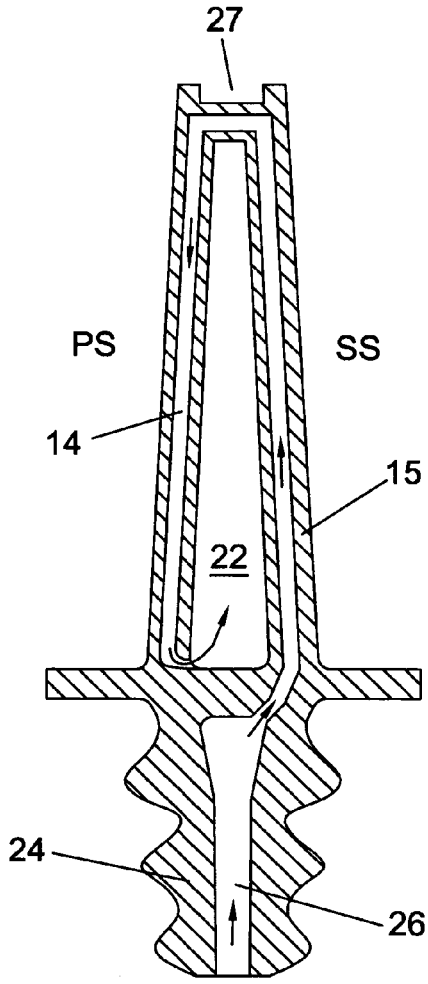
FIG.3 shows a cross section view of another section of the FIG. 1 airfoil.

FIG. 2 shows a cross section view of a section of the blade in FIG. 1. The blade includes a root 24 that has a cooling air supply passage 26. An elbow bend entrance region 25 is located in the blade near the platform and opens into the pressure side radial extending channel 14. The pressure side channel 14 extends from the elbow bend to a cooling channel in the tip region 27 of the blade, where the cooling flow supplies cooling air to cool the tip region 27. The cooling passage then flows down into the suction side channel 15 toward the platform, where the cooling air is then discharged into the collector cavity 22. Adjacent to this cooling flow arrangement in FIG. 1 is the cooling flow arrangement shown in FIG. 3. The radial channels and tip cooling channel in FIG. 3 and the same as in FIG. 2 except that the flow direction is reversed. The flow direction in FIG. 3 flows from the root supply passage 26 into the suction side channel 15, through the tip region channel, and then down the pressure side channel 14 before discharging into the collector cavity 22. Thus, the number of pressure side channels 14 used is the same as the number of suction side channels 15. This alternating series of flow directions provides for a more uniform through wall temperature and lower thermally induced stress in the airfoil due to high temperatures.

All of the radial channels 14 and 15 associated with a collector cavity are supplies by a common root supply passage. In the FIG. 1 embodiment, the same root supply passage 26 delivers cooling air to the channels associated with both of the collector cavities 20 and 22. However, the radial channels associated with the forward collector cavity 20 can be supplied by a separate root supply passage than the radial channels associated with the aft collector cavity 22.

The film cooling holes 13 that form the showerhead and the film cooling holes 16 on the blade surfaces, and the cooling holes 18 at the trailing edge of the blade are all supplies from the collector cavities 20 and 22. By passing the cooling air through the pressure and suction side channels 14 and 15 before discharging the cooling air through the film cooling holes allows for the use of less cooling air from the compressor bleed off, and therefore improves the efficiency of the engine. The alternating flow direction of the series of radial channels also reduces conduction thickness and increases the airfoil overall heat transfer convection capability, and therefore reduces the airfoil mass average metal temperature. This allows for higher hot gas flow temperatures into the turbine which also increases the efficiency of the engine.

In an additional embodiment of the present invention shown in FIG. 1, more than the two collector cavities 20 and 22 can be used. For example, if three collector cavities are used, then two ribs would be required to separate the cavities. By separating the cavities, different pressures can be used in each cavity. Each of the three cavities can be used to discharge cooling air to film cooling holes at desired location so the airfoil. Besides regulating the pressure of the cooling air within the respective cavities, the airflow into the cavities can also be regulated to control cooling and airflow volume.

Figure 4:
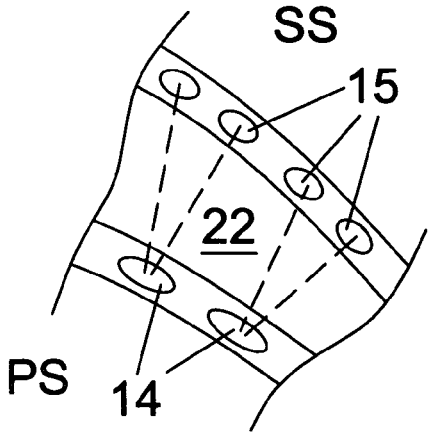
FIG. 4 shows an alternate embodiment of the present invention in which a single channel on one side of the airfoil feeds into a plurality of channels on the opposite side of the blade.
Figure 5:
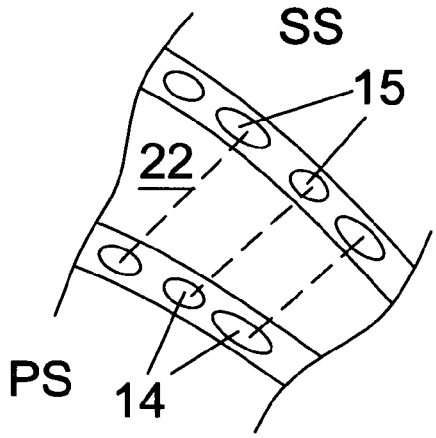
FIG. 5 shows a further embodiment of the present invention in which the channels have different cross sectional areas.

In another embodiment, instead of the number of pressure side channels 14 being equal to the number of suction side channels 15 because one pressure side channels 14 feeds only one suction side channel 15, the number of channels can be different. For example, one pressure side channel 14 can feed into two or more suction side channels 15. Also, the two suction side channels 15 can have different cross sectional areas than the pressure side channel 14 that is in fluid communication therewith. Or, two or more pressure side channels 14 can feed into a single suction side channel. FIG. 4 shows a pressure side channel 14 in communication with two suction side channels 15 as represented by the dashed lines. Since the flow direction alternates for adjacent channels, one pressure side channel 14 could deliver cooling air to two or more suction side channels 15, or one suction side channel 15 could deliver cooling air to two ore more pressure side channels 14. FIG. 5 shows a one-to-one pressure side to suction side channel arrangement in which the pressure side channel 14 could be larger than the suction side channel 15.

I claim the following:

1. A turbine airfoil for use in a gas turbine engine, the airfoil including a pressure side and a suction side, a leading edge and a trailing edge, and a tip region, the airfoil comprising:

a collector cavity formed within the airfoil;

a cooling air supply passage to deliver a cooling air from an external source to the airfoil;

a near-wall cooling passage including a pressure side radial extending cooling channel and a suction side radial extending cooling channel, the two channels being in fluid communication at the airfoil tip region;

an entrance of the near-wall cooling passage being in fluid communication with the cooling air supply passage, and an exit of the near-wall cooling passage being in fluid communication with the collector cavity;

a second near wall cooling passage including a second pressure side radial extending channel and a second suction side radial extending channel in fluid communication with each other at the airfoil tip region;

the first near wall cooling passage being fluidly connected to the supply passage and the collector cavity such that cooling air flows into the pressure side channel before the suction side channel;

the second near wall cooling passage being fluidly connected to the supply passage and the collector cavity such that cooling air flows into the suction side channel before the pressure side channel; and, a plurality of film cooling holes in fluid communication with the collector cavity, whereby the cooling air passes through the cooling channels and into the collector cavity before passing through the film cooling holes.

2. The turbine airfoil of claim 1, and further comprising:

the entrance to the pressure side channel is in fluid communication with the cooling air supply passage; and, the exit from the suction side channel is in fluid communication with the collector cavity.

3. The turbine airfoil of claim 1, and further comprising:

a second collector cavity located within the airfoil and separated from the first collector cavity by a rib;

a third near wall cooling passage including a third pressure side radial extending channel and a third suction side radial extending channel in fluid communication through a tip region;

an entrance of one of the third near-wall cooling passage being in fluid communication with the cooling air supply passage, and an exit of the third near-wall cooling passage being in fluid communication with the collector cavity; and, a plurality of third film cooling holes in fluid communication with the third collector cavity, whereby the cooling air passes through the third cooling channels and into the third collector cavity before passing through the third film cooling holes.

4. The turbine airfoil of claim 3, and further comprising:

a second cooling air supply passage;

the first near-wall cooling passage being in fluid communication with the first cooling air supply passage; and, the second near-wall cooling passage being in fluid communication with the second cooling air supply passage.

5. The turbine airfoil of claim 1, and further comprising:

the entrance to the near-wall cooling passage being in fluid communication with the supply passage through a first elbow bend.

6. The turbine airfoil of claim 1, and further comprising:

the entrance to the first near-wall cooling passage being in fluid communication with the supply passage through a first elbow bend; and, the entrance to the second near-wall cooling passage being in fluid communication with the supply passage through a second elbow bend.

7. The turbine airfoil of claim 1, and further comprising:

some of the film cooling holes include diffusers to provide better film cooling of the airfoil surface.

8. The turbine airfoil of claim 1, and further comprising:

the radial extending channels extend substantially from a platform region to a tip region of the airfoil.

9. The turbine airfoil of claim 1, and further comprising:

a tip region cooling channel to provide fluid communication between the pressure side channel and the suction side channel, the tip region channel provides cooling for the tip region.

10. The turbine airfoil of claim 1, and further comprising:

a showerhead cooling arrangement to provide cooling air for the leading edge of the airfoil, the showerhead arrangement being in fluid communication with the first collector cavity; and, a trailing edge cooling passage to provide cooling for the trailing edge of the airfoil and cooling air to exit holes of the trailing edge, the trailing edge cooling passage being in fluid communication with the second collector cavity.

11. The turbine airfoil of claim 1, and further comprising:

the pressure side radial channel is in fluid communication with more than one suction side radial channels.

12. The turbine airfoil of claim 1, and further comprising:

the suction side radial channel is in fluid communication with more than one pressure side radial channels.

13. The turbine airfoil of claim 1, and further comprising:

at least one of the pressure side radial channels has a different cross sectional area than at least one of the suction side radial channels.

14. The turbine airfoil of claim 1, and further comprising:

at least one of the pressure side radial channels has a different cross sectional area than another pressure side radial channel.

15. The turbine airfoil of claim 1, and further comprising:

at least one of the suction side radial channels has a different cross sectional area than another suction side radial channel.

16. A process for cooling a turbine airfoil, the airfoil having a cooling air supply channel and a collector cavity, the process comprising the steps of:

supplying cooling air to the supply channel;

passing cooling air along a first cooling passage that extends from the supply channel, along the pressure side of the airfoil, over the tip region, and down the suction side of the airfoil and then discharges into the collector cavity;

passing cooling air along a second cooling passage, the second cooling passage being located adjacent to the first cooling passage, the second cooling passage extending from the supply channel and passes along the suction side, then over the tip region, and then down the pressure side, discharging into the collector cavity; and, discharging cooling air from the collector cavity through a plurality of film cooling holes onto the surface of the airfoil.

17. The process for cooling a turbine airfoil of claim 16, and further comprising the step of:

passing the cooling air along the pressure side and suction side of the airfoil from substantially a platform of the airfoil to substantially the tip region of the airfoil.

18. A turbine blade comprising:

an airfoil section having a pressure side and a suction side;

a collector cavity formed within the airfoil;

a cooling air supply passage to deliver cooling air from an external source to the airfoil;

a first near-wall cooling passage having an inlet connected to the cooling air supply passage and an outlet connected to the collector cavity;

the first near-wall cooling passage including a pressure side radial extending near-wall cooling channel, a first blade tip cooling channel and a suction side radial extending near-wall cooling channel in which the cooling air flows from the pressure side channel through the first tip channel and then through the suction side channel before discharging into the collector cavity; and, a plurality of film cooling holes in connected to the collector cavity to discharge spent cooling air.

19. The turbine blade of claim 18, and further comprising:

the first near-wall cooling passage is a closed passage from the cooling air supply passage to the collector cavity.

20. The turbine blade of claim 18, and further comprising:

a second near-wall cooling passage having an inlet connected to the cooling air supply passage and an outlet connected to the collector cavity;

the second near-wall cooling passage including a suction side radial extending near-wall cooling channel, a second blade tip cooling channel and a pressure side radial extending near-wall cooling channel in which the cooling air flows from the suction side channel through the second tip channel and then through the pressure side channel before discharging into the collector cavity.

21. The turbine blade of claim 20, and further comprising:

the first and second near-wall cooling passages are both closed passages from the cooling air supply passage to the collector cavity.

22. The turbine blade of claim 21, and further comprising:

the first and second near-wall cooling passages both extend along the entire airfoil wall from a platform to the blade tip.

* * * * *